US006092399A

United States Patent [19]

Tung et al.

[11] Patent Number: 6,092,399

[45] Date of Patent: Jul. 25, 2000

[54] ROLLING DRUM TYPE WASHING STRUCTURE OF A CLOTH WASHING APPARATUS

[76] Inventors: Wan-Chin Tung; Jing-Shing Chern, both of P.O. Box 82-144, Taipei, Taiwan

[21] Appl. No.: 09/122,888

[22] Filed: Jul. 28, 1998

[51] Int. Cl.[7] ..... D06B 1/02

[52] U.S. Cl. ..... 68/5 D; 68/22 R; 68/205 R

[58] Field of Search ..... 68/5 D, 5 E, 22 R, 68/205 R

[56] References Cited

U.S. PATENT DOCUMENTS

| | | | |
|---|---|---|---|
| 2,080,635 | 5/1937 | Schramek et al. | 68/205 R |
| 3,098,371 | 7/1963 | Fleissner | 68/205 R X |
| 3,163,030 | 12/1964 | Woodworth, Jr. | 68/205 R |
| 3,763,672 | 10/1973 | Bahnsen | 68/205 R |
| 3,886,769 | 6/1975 | Conti | 68/205 R X |
| 4,135,373 | 1/1979 | Conti | 68/205 R X |
| 4,180,994 | 1/1980 | Lemon et al. | 68/205 R X |

*Primary Examiner*—Philip R. Coe
*Attorney, Agent, or Firm*—A & J

[57] ABSTRACT

A rolling drum type washing structure of a washing apparatus includes a transmission device including a first roller, a first knife roller and a first conveyor belt connecting the first roller and the first knife roller, a rinsing device including a net drum and two second rollers arranged under the net drum, the two second rollers being drivingly connected with the net drum, three water reservoirs with an open top arranged within the net drum and each pivotally mounted on an axle longitudinally extending across the net drum, and eleven spraying pipes disposed above the net drum and each provided with a plurality of perforations, and a squeezing device including a second knife roller, two third rollers, a second conveyor belt, two upper squeezing rollers and two lower squeezing rollers, whereby the cloths are washed one by one thus thoroughly cleaning the cloth.

1 Claim, 3 Drawing Sheets

ROLLING DRUM TYPE WASHING STRUCTURE OF A CLOTH WASHING APPARATUS

BACKGROUND OF THE INVENTION

1. Field of the Invention

This invention is related to a rolling drum type washing structure of a cloth washing apparatus and in particular to one which can clean clothes thoroughly.

2. Description of the Prior Art

It has been found that the conventional washing machines fall into two categories, i.e. the rolling type and the tunnel type. Both types of the washing machines utilize running water to clean a large amount of clothes at the same time, and so the clothes cannot be cleaned thoroughly. In addition, the cylindrical member of the rolling type washing machine rotates at a high speed in use thereby producing noise pollution in operation and therefore causing damage to the operator's health, whereas the tunnel type washing machine is used for washing only and so it is necessary to move the cloth with manual power to a drier for drying thus causing much inconvenience in use.

Therefore, it is an object of the present invention to provide an improved washing structure of a washing apparatus which can obviate and mitigate the above-mentioned drawbacks.

SUMMARY OF THE INVENTION

This invention is related to an improved washing structure of a washing apparatus.

According to the preferred embodiment of the present invention, a rolling drum type washing structure of a washing apparatus includes a transmission device including a first roller, a first knife roller and a first conveyor belt connecting the first roller and the first knife roller, a rinsing device including a net drum and two second rollers arranged under the net drum, the two second rollers being drivingly connected with the net drum, three water reservoirs with an open top arranged within the net drum and each pivotally mounted on an axle longitudinally extending across the net drum, and eleven spraying pipes disposed above the net drum and each provided with a plurality of perforations, and a squeezing device including a second knife roller, two third roller, a second conveyor belt, two upper squeezing rollers and two lower squeezing rollers, whereby the cloths are washed one by one.

It is the primary object of the present invention to provide a rolling drum type washing structure of a washing apparatus machine which can clean the cloth thoroughly.

It is another object of the present invention to provide a rolling drum type washing structure of a washing apparatus which is provided with ironing and folding devices.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
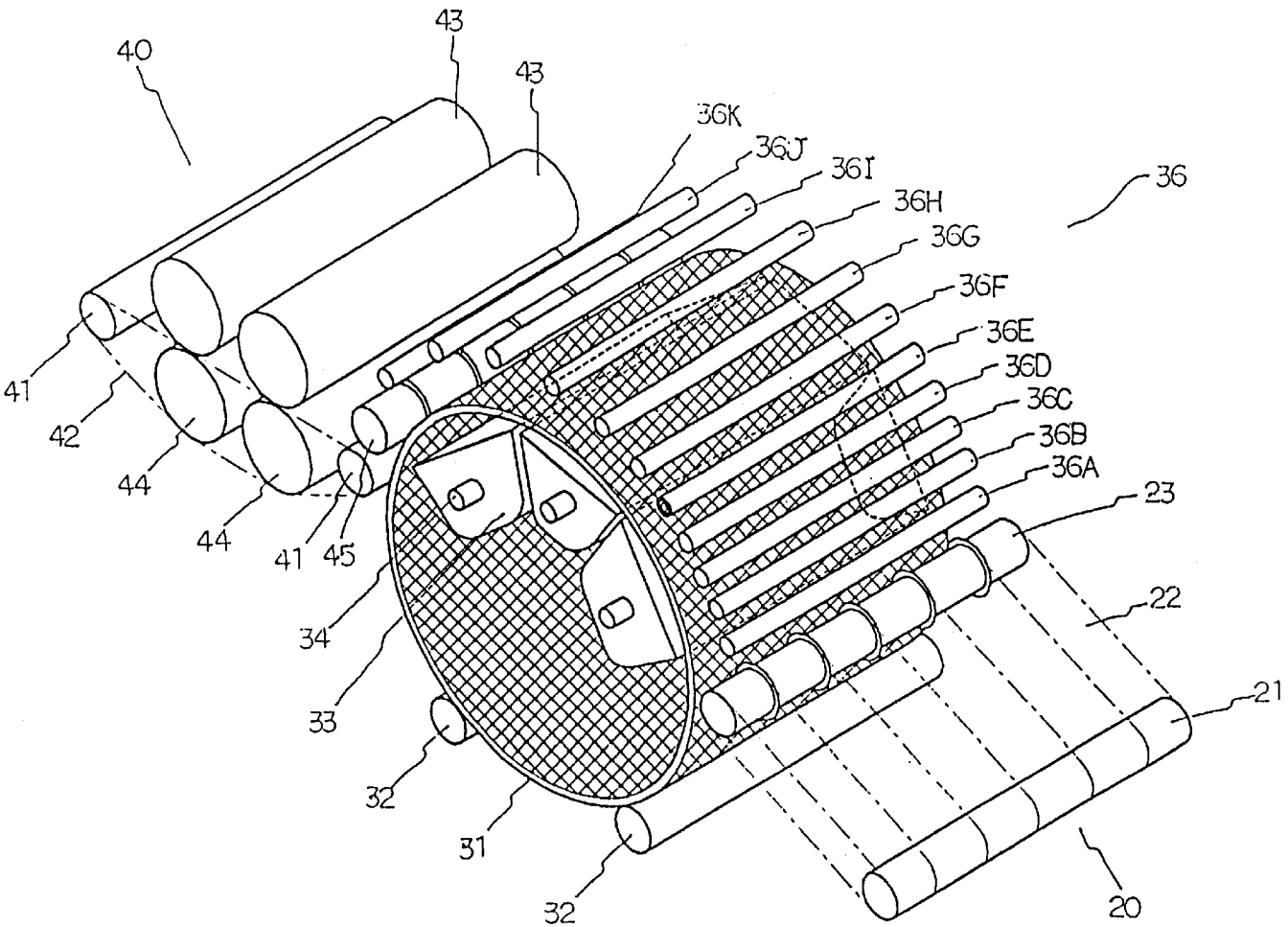
FIG. 1 is a perspective view of a rolling drum type washing structure of a washing apparatus according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
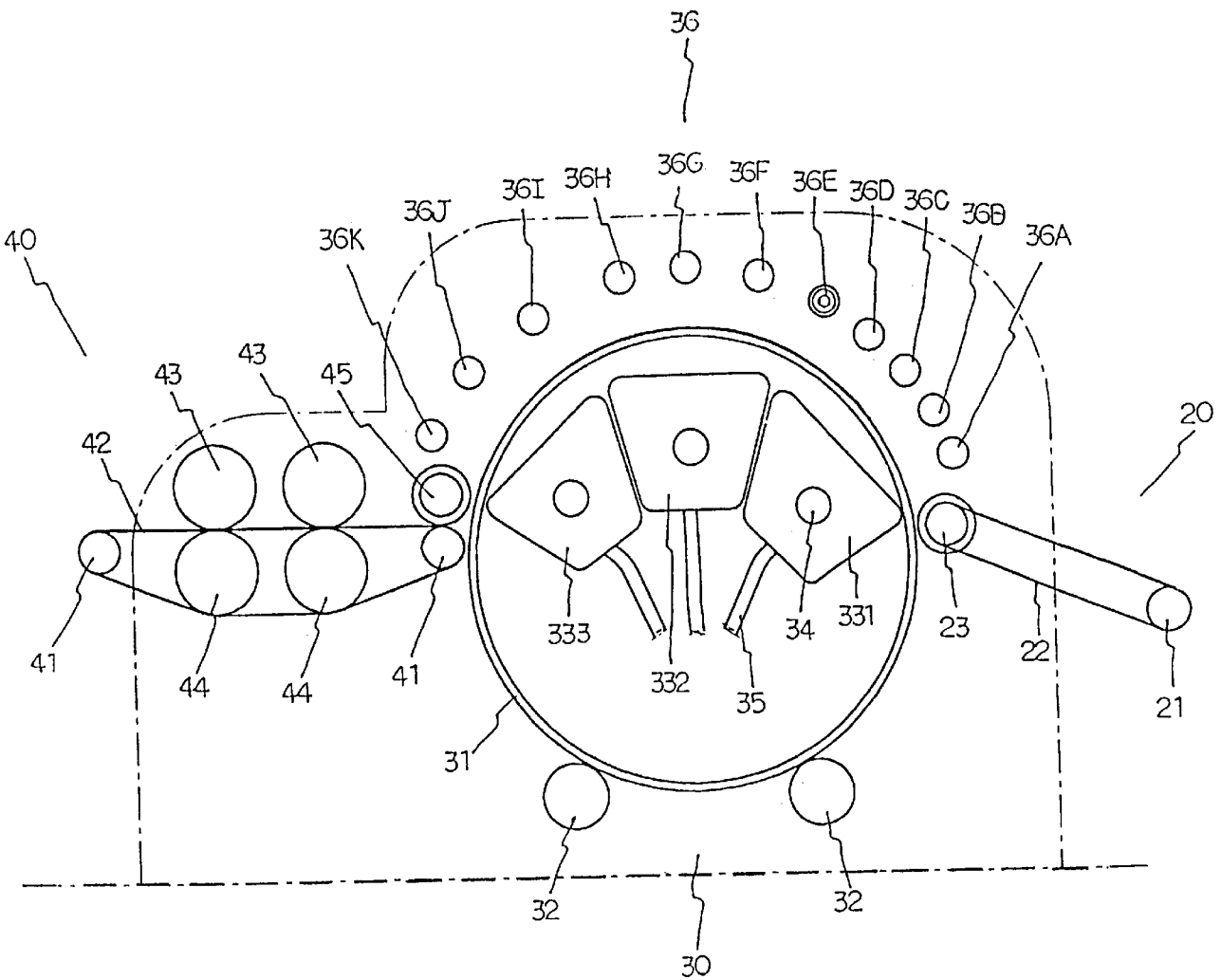
FIG. 2 is a front view of the present invention.

With reference to the drawings and in particular to FIGS. 1 and 2 thereof, the rolling drum type washing structure of a cloth washing apparatus according to the present invention is arranged within a housing (not shown) on which there are a control panel (not shown), an inlet (not shown) and an outlet (not shown). The rolling drum type washing structure generally comprises a transmission device 20, a rinsing device 30 and a squeezing device 40.

The transmission device 20 includes a roller 21, a knife roller 23 and a conveyor belt 22. The knife roller 23 is disposed close to the net drum 31 of the rinsing device 30 and mainly used for transmitting bed sheets, tablecloths, clothes or the like to the rinsing device 30.

The rinsing device 30 includes a net drum 31 and two rollers 32 arranged in contact with the lower portion of the net drum 31. The two rollers 32 are driven by a motor (not shown) so that the rollers 32 will drive the net drum 31 to rotate when the motor is turned on. Three water reservoirs 33 with an open top are mounted within the net drum 31. The water reservoir 33 is pivotally mounted on an axle 34 longitudinally extending across the net drum 31. Two ends of the axle 34 are journalled by suitable means so that the water reservoirs 33 will not be influenced when net drum 31 is rotated. The bottom of each of the water reservoirs 33 is connected to a cyclic supplying device (not shown) via a pipe 35 so that the water in the water reserviors 33 may be transmitted to the cyclic supplying device. Eleven spraying pipes 36 are longitudinally mounted above the net drum 31 and each provided with a plurality of perforations. The eleven spraying pipes 36 are also connected to the cyclic supplying device.

The squeezing device 40 includes a roller 41, a knife roller 45, a conveyor belt 42, two upper squeezing rollers 43 and two lower squeezing rollers 44. The knife roller 45 is arranged in contact with the net drum 31 of the rinsing device 30. The upper squeezing rollers 43 are mounted on the upper side of the conveyor belt 42, while the lower squeezing rollers 44 are arranged under the upper squeezing rollers 43 and within the conveyor belt 42. Hence, when a piece of cloth passes between the upper and lower rollers 43 and 44, the cloth will be squeezed thereby removing water therefrom.

Figure 3:
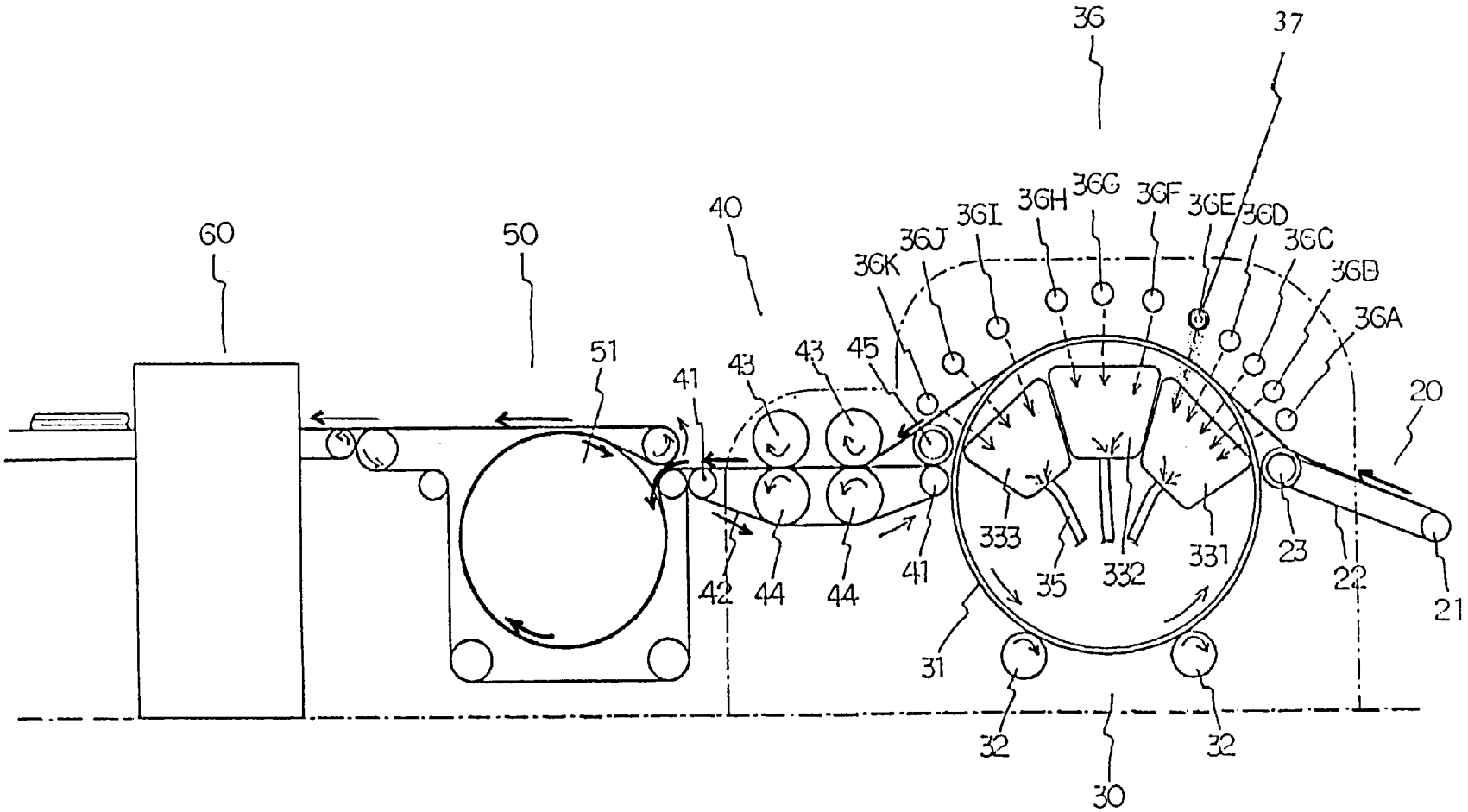
FIG. 3 is a working view of the present invention.

By means of the above-mentioned means, the cloth is put on the conveyor belt 22 of the transmission device 20 through an inlet of the housing of the washing machine (not shown) and then the cloth is transmitted to the rinsing device 30 behind the transmission device 20 by the rotation of the roller 21. Referring to FIG. 3, an ironing device 50 is arranged behind the squeezing device 40 and a folding device 60 is in turn mounted behind the ironing device 50, so that the cloth after cleaning will be transmitted to the ironing device 50 for ironing by a heating drum 71 and then the cloth is transmitted to the folding machine 60 for folding.

As cloth enters into the rinsing device 30, the cloth will be first arranged on the surface of the net drum 31 so that the cloth will be rotated in unison with the net drum 31 thereby passing through the spraying pipes 36. Meanwhile, the first spraying pipe 36A will eject fog-like cleaning agent on the cloth, the second spraying pipe 36B will eject water to wet the cloth, the third spraying pipe 36C will eject steam to the cloth, the fourth spraying pipe 36D will spray bleaching agent to the cloth, and the fifth to eleventh spraying pipes 36E, 36F, 36G, 36H, 36I, 36J and 36K will eject strong water streams to the cloth, so that the cloth will be thoroughly cleaned after rotating about a half circle with the net drum 31. Thereafter, the cloth is transmitted to the squeezing device 40 behind the net drum 31. In addition, the fifth spraying pipe 36E is provided with an ultrasonic wave generator 37 so that the fifth sparying pipe 36E will eject strong water current and emit ultrasonic waves to the cloth thereby sterilizing the cloth.

After the cloth enters into the squeezing device 40, the cloth will be placed on the conveyor belt 42 which will be driven by the rollers 41 to transmit the cloth to pass through the two pairs of squeezing rollers 43 and 44 thereby drying the cloth.

The three water reservoirs 33 are used for collecting water from the eleven spraying pipes 36, wherein the water ejected by the spraying pipes 36H, 36I, 36J and 36K is clean so that the water collected by the third water reservoir 333 will be retrieved by the cyclic water supplying device which will then supply the water to the fifth to seventh spraying pipes 36E, 36F and 37G. The water ejected by the fifth to seventh spraying pipes 36E, 36F and 36G will be collected by the second water reservoir 332 and retrieved by the cyclic water supplying device and then mixed with cleaning agent and bleaching agent to supply to the first to fourth spraying pipes 36A, 36B, 36C and 36D. The water ejected by the first to fifth spraying pipes 36A, 36B, 36C, 36D and 36E are waste water with chemicals, and collected by the first water reservoir which will discharge the waste water through the a drain pipe 35.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A rolling drum type washing structure for a washing apparatus comprising:

a transmission device including a first roller, a first knife roller and a first conveyor belt connecting said first roller and said first knife roller;

a rinsing device including a net drum and two second rollers arranged under said net drum, said two second rollers being drivingly connected with said net drum, three water reservoirs with an open top arranged within said net drum and each pivotally mounted on an axle longitudinally extending across said net drum, and eleven spraying pipes disposed above said net drum and each provided with a plurality of perforations, first one of said eleven spraying pipes being used for ejecting cleaning agent to a cloth, second one of said eleven spraying pipes being used for ejecting water to wet said cloth, third one of said eleven spraying pipes being used for ejecting steam to said cloth, fourth one of said eleven spraying pipes being used for ejecting bleaching agent to said cloth, fifth to eleventh ones of said eleven spraying pipes being used for ejecting strong water stream to said cloth, and said net drum being disposed adjacent to said first knife roller, said fifth one of said eleven spraying pipes being provided with an ultrasonic generator; and a squeezing device including a second knife roller, two third rollers, a second conveyor belt, two upper squeezing rollers and two lower squeezing rollers, said second knife roller being arranged in contact with said net drum of said rinsing device, said upper and lower squeezing rollers being mounted on an upper side of said conveyor belt and within said second belt under said upper squeezing rollers.

* * * * *